US006332708B1

(12) United States Patent
Gonzalez et al.

(10) Patent No.: US 6,332,708 B1
(45) Date of Patent: Dec. 25, 2001

(54) METHOD OF SHIPPING MANGANESE DIOXIDE

(75) Inventors: Jesus Gonzalez, St. Hubert; RenéBernier, Laprairie, both of (CA)

(73) Assignee: Cametox 2000 Inc., Boucherville (CA)

( * ) Notice: Subject to any disclaimer, the term of this patent is extended or adjusted under 35 U.S.C. 154(b) by 0 days.

(21) Appl. No.: 09/653,367

(22) Filed: Aug. 31, 2000

(51) Int. Cl.[7] ..... B01F 3/12
(52) U.S. Cl. ..... 366/348
(58) Field of Search ..... 366/348, 2, 3, 366/10, 12, 13, 53, 54, 64, 208, 218, 219, 220; 406/39, 38, 134, 135, 136, 137; 105/247; 414/812, 787

(56) References Cited

U.S. PATENT DOCUMENTS

| | | | | |
|---|---|---|---|---|
| 1,652,960 | * | 12/1927 | Snelling et al. | 414/373 |
| 1,896,616 | * | 2/1933 | Gillican | 366/147 |
| 2,143,273 | * | 1/1939 | Ladd | 406/137 |
| 2,522,077 | * | 9/1950 | Wahl et al. | 415/502 |
| 3,510,463 | | 5/1970 | Bristol . | |
| 3,606,036 | * | 9/1971 | Beebe et al. | 406/137 |
| 3,615,179 | | 10/1971 | Rosenberg et al. | 423/476 |
| 3,884,373 | * | 5/1975 | Archibald | 406/146 |
| 3,897,936 | * | 8/1975 | Berthold et al. | 366/209 |
| 3,937,162 | * | 2/1976 | Fukutani | 114/382 |
| 3,985,668 | | 10/1976 | Hartman | 252/99 |
| 4,082,124 | * | 4/1978 | Jenkins | 141/65 |
| 4,082,227 | * | 4/1978 | McGrane et al. | 366/195 |
| 4,117,645 | * | 10/1978 | Phillips | 53/431 |
| 4,157,872 | * | 6/1979 | Davido, Sr. | 366/64 |
| 4,297,309 | | 10/1981 | North . | |
| 4,329,090 | * | 5/1982 | Teague et al. | 366/7 |
| 4,335,982 | * | 6/1982 | Bratschitsch | 406/48 |
| 4,514,093 | * | 4/1985 | Coch et al. | 366/138 |
| 4,599,004 | * | 7/1986 | Keith | 366/241 |
| 5,147,133 | * | 9/1992 | White | 366/138 |
| 5,269,604 | * | 12/1993 | Ewers | 366/277 |
| 5,385,668 | | 1/1995 | Greenhalgh et al. . | |
| 5,439,317 | | 8/1995 | Bishop et al. | 405/129.2 |
| 5,462,723 | | 10/1995 | Berry | 423/347 |
| 5,507,572 | * | 4/1996 | Shields et al. | 366/6 |
| 5,537,934 | | 7/1996 | Jensen et al. | 106/487 |
| 5,573,188 | | 11/1996 | Bousquet et al. . | |
| 5,603,568 | * | 2/1997 | Mobley et al. | 366/196 |
| 5,626,423 | * | 5/1997 | Rumph | 366/270 |
| 5,852,068 | * | 12/1998 | Rumph | 366/348 |
| 6,000,349 | * | 12/1999 | Sterken | 111/118 |
| 6,071,005 | | 6/2000 | Ekambaram et al. | 366/173.2 |
| 6,134,863 | * | 10/2000 | Knox | 53/432 |

* cited by examiner

*Primary Examiner*—Tony G. Soohoo
(74) *Attorney, Agent, or Firm*—Swabey Ogilvy Renault; Robert Mitchell

(57) ABSTRACT

A shipping method which reduces the potential hazards during shipment of manganese dioxide. The manganese dioxide is transported in suspension in a liquid contained in a container. The manganese dioxide is maintained in suspension by continuously agitating the manganese dioxide slurry in the container during shipment.

11 Claims, No Drawings

METHOD OF SHIPPING MANGANESE DIOXIDE

BACKGROUND OF THE INVENTION

1. Field of the Invention

The present invention relates to the transportation of powder materials and, more particularly, to a method for shipping manganese dioxide.

2. Description of the Prior Art

Presently, manganese dioxide ($MnO_2$) is shipped in the form of a powder bagged in individual paper bags. In this form, the manganese dioxide has numerous hazardous characteristics and, thus, various precautionary measures must be taken while handling this product. These precautionary measures contribute to increase the costs associated with the transportation of the manganese dioxide from a place of origin to a destination.

Manganese dioxide powder will accelerate burning when involved in a fire and produce irritating and corrosive gases and, thus, the transportation thereof is severely regulated.

It would be advantageous to find a new shipping method which would eliminates the need for shipping manganese dioxide under the requirements imparted by the regulations so that the transportation of manganese dioxide could be effectuated safely and economically.

SUMMARY OF THE INVENTION

It is therefore an aim of the present invention to provide a novel method for shipping manganese dioxide in a manner such as to reduce hazards during shipment.

It is also an aim of the present invention to provide a manganese dioxide shipping method which is economical.

Therefore, in accordance with the present invention, there is provided a method of transporting manganese dioxide from a place of origin to a remote destination, comprising the steps of providing a mixture of liquid and manganese dioxide in a container suitable for transportation, the manganese dioxide being insoluble in said liquid, continuously agitating said mixture within said container to maintain the manganese dioxide in suspension in the liquid so as to prevent sedimentation of the manganese dioxide, and transporting said container to said remote destination while said mixture is being maintained in suspension.

DESCRIPTION OF THE PREFERRED EMBODIMENTS

Manganese dioxide is an oxidizing substance commonly used as a cement colorant or simply as an oxidizing agent. Manganese dioxide is typically manufactured and/or mined in the form of a powder substance. This powder has numerous potential hazards and requires special consideration in its handling and storage. For instance, manganese dioxide powder will accelerate burning when involved in a fire. The fire may produce irritating, corrosive and/or poisonous gases. The inhalation, ingestion or contact (skin, eyes) with vapors, dusts or the powder may cause metal fume fever and/or manganism, a disease of the central nervous system similar to Parkinsonism.

Therefore, stringent requirements must be taken while handling and transporting manganese dioxide powder.

In accordance with the present invention, it has been found that potential hazards can be significantly reduced by shipping the manganese dioxide in suspension in a liquid. According to a preferred embodiment of the present invention, the liquid consists of water. However, other liquids could be used as long as the manganese dioxide remains insoluble in this particular liquid.

The solution comprises between 10% to 80% weight to weight of solid. However, the preferred proportion is 50% weight to weight of solid.

A predetermined volume of the liquid (about 50% of the total volume of liquid) is first introduced in a transportable container mounted for rotation about a longitudinal axis thereof. The container can be mounted on the frame of a wheeled vehicle or any other transport vehicle. Once the predetermined volume of liquid has been reached, the manganese dioxide starts to be gradually introduced into the container while the liquid continues to flow therein. The size of the manganese dioxide particles can vary from about 0 to about 1000 microns. However, a preferred size range is 0 to 75 microns. During the conjoint loading operation of the liquid and the manganese dioxide, the container is driven in rotation at an appropriate speed to prevent the sedimentation of the manganese dioxide powder. A rotating speed comprised between about 2 to about 30 rpm has been found satisfactory.

The manganese dioxide powder is directed from a source of manganese dioxide into the container at a rate controlled by a conveyor, for instance, a screw conveyor.

Once the manganese dioxide powder has been completely loaded into the rotating container, the remaining liquid is used to wash the inner surface of the container so as to ensure that no residue of manganese dioxide powder remains stuck to the inner surface of the container.

After the liquid and the manganese dioxide have been completely introduced into the container, the latter is transported to a remote destination. During the transportation, the container is continuously rotated so as to agitate the manganese dioxide slurry contained therein and, thus, prevent the powder from sinking to the bottom of the container. Without continuously agitating the manganese dioxide slurry, the powder, because of its greater density, would sink to the bottom of the liquid, thereby rendering the unloading of the manganese dioxide very difficult.

By transporting the manganese dioxide in suspension in a liquid the potential hazards associated therewith are reduced to a point where the need for shipping the manganese dioxide under the requirements established for solid manganese dioxide are eliminated.

At destination, the manganese dioxide slurry, i.e. the mixture of liquid and manganese dioxide powder, is unloaded from the container through the use of a positive pressure pump. The container is still driven in rotation during the unloading operation. Once the slurry has been withdrawn from the container, the manganese dioxide can be separated from the liquid by any appropriate process, if need be.

Instead of using a rotating container to maintain the manganese dioxide in suspension as described hereinbefore, containers of the type having internal rotating blades at the bottom thereof could be used to agitate the slurry.

What is claimed is:

1. A method of transporting manganese dioxide from a place of origin to a remote destination, comprising the steps of providing a mixture of liquid and manganese dioxide in a container suitable for transportation, the manganese dioxide being insoluble in said liquid, continuously agitating said mixture within said container to maintain the manganese dioxide in suspension in the liquid so as to prevent sedimentation of the manganese dioxide, and transporting said container to said remote destination while said mixture is being maintained in suspension.

2. A method as defined in claim 1, wherein the step of providing a mixture of liquid and manganese dioxide into a container is effected by first introducing a predetermined volume of liquid into the container and then gradually introducing the manganese dioxide into the container.

3. A method as defined in claim 2, wherein the liquid continues to be introduced into the container while the manganese dioxide is being introduced therein.

4. A method as defined in claim 3, wherein the step of introducing the manganese dioxide into the container is effected by providing the manganese dioxide in the form of a powder, and operating a screw conveyor to gradually direct the powder into the container to be mixed with the liquid already introduced therein.

5. A method as defined in claim 4, wherein said liquid is water.

6. A method as defined in claim 3, further comprising the step of washing the inner surface of the container with the liquid once the manganese dioxide has been completely introduced in the container.

7. A method as defined in claim 2, comprising the steps of rotating the container while the manganese dioxide is being introduced into the container.

8. A method as defined in claim 1, wherein the step of continuously agitating the mixture is effected by rotating the container upon itself.

9. A method as defined in claim 8, wherein the container is rotated about a longitudinal axis thereof.

10. A method as defined in claim 8, wherein the container is rotated at a speed comprised between about 2 to about 30 rpm.

11. A method as defined in claim 1, further comprising the step of pumping the mixture out of the container when arrived at the remote destination, the mixture being pumped while still being agitated.

* * * * *